US009377268B2

(12) United States Patent
White

(10) Patent No.: US 9,377,268 B2
(45) Date of Patent: Jun. 28, 2016

(54) ARCHERY GRIP SYSTEM

(71) Applicant: Affinity Labs of Texas, LLC, Dripping Springs, TX (US)

(72) Inventor: Russell W. White, Austin, TX (US)

(73) Assignee: Vitalz Outdoors, LLC, Georgetown, TX (US)

( * ) Notice: Subject to any disclaimer, the term of this patent is extended or adjusted under 35 U.S.C. 154(b) by 155 days.

(21) Appl. No.: 14/156,622

(22) Filed: Jan. 16, 2014

(65) Prior Publication Data

US 2014/0196705 A1 Jul. 17, 2014

Related U.S. Application Data

(60) Provisional application No. 61/753,522, filed on Jan. 17, 2013.

(51) Int. Cl.

| | |
|---|---|
| ***F41B 5/14*** | (2006.01) |
| ***F41B 5/00*** | (2006.01) |
| *F41B 5/10* | (2006.01) |

(52) U.S. Cl.

CPC ..... *F41B 5/1403* (2013.01); *F41B 5/0031* (2013.01); *F41B 5/14* (2013.01); *F41B 5/10* (2013.01)

(58) Field of Classification Search

CPC ..... F41B 5/00; F41B 5/1403; F41B 5/14; F41B 5/10; F41B 5/31

See application file for complete search history.

(56) References Cited

U.S. PATENT DOCUMENTS

| | | | | | |
|---|---|---|---|---|---|
| 4,257,385 | A * | 3/1981 | Stewart | F41G 1/467 | 124/24.1 |
| 5,243,958 | A * | 9/1993 | Shepley, Jr. | F41B 5/0031 | 124/23.1 |
| 5,551,413 | A * | 9/1996 | Walk | 124/88 | |
| 5,615,663 | A * | 4/1997 | Simonds | 124/88 | |
| 5,853,000 | A * | 12/1998 | Torgerson | F41B 5/14 | 124/88 |
| 2011/0132344 | A1* | 6/2011 | Moon et al. | 124/88 | |
| 2011/0259309 | A1* | 10/2011 | Oppenheim | 124/23.1 | |
| 2013/0047379 | A1* | 2/2013 | Zilke | 16/421 | |

OTHER PUBLICATIONS

U.S. Appl. No. 15/006,199, filed Jan. 26, 2016, entitled "An Archery Grip System," by Russell W. White.

* cited by examiner

*Primary Examiner* — John E Simms, Jr.

(57) ABSTRACT

A system for bow gripping is disclosed. A system incorporating teachings of the present disclosure may include a grip component configured to couple to a bow. In some embodiments, the grip component may interact and/or attached to an archer's lead hand. Some components may have a third metacarpal offset that encourages a grip angle of over twenty degrees. Depending on design goals, the encouraged grip angle may also be larger or smaller than twenty degrees. The grip component may also include a mechanism for attaching the component to an archer's bow or hand.

15 Claims, 3 Drawing Sheets

ARCHERY GRIP SYSTEM

This application claims priority to U.S. Provisional Patent Application Ser. No. 61/753,522, filed Jan. 17, 2013, the content of which is hereby incorporated by reference.

TECHNICAL FIELD

The following disclosure relates to archery equipment, and more particularly to a gripping system for improved shooting.

BACKGROUND

Generally speaking, archery is the practice of shooting arrows from a bow. In its most rudimentary form, it has been around for over 10,000 years. In modern times, archery is used as both a hunting technique and a recreational activity.

DETAILED DESCRIPTION

As mentioned above, archery is used as both a hunting technique and a recreational activity. In both scenarios, accuracy is of the utmost importance. Using bow sites and mechanical releases can help, but they are relatively ineffective if the archer cannot find and maintain a proper shooting position at full draw and release. It is the process of finding and maintaining this proper shooting position that leads to accurate shooting for most archers.

Figure 3:
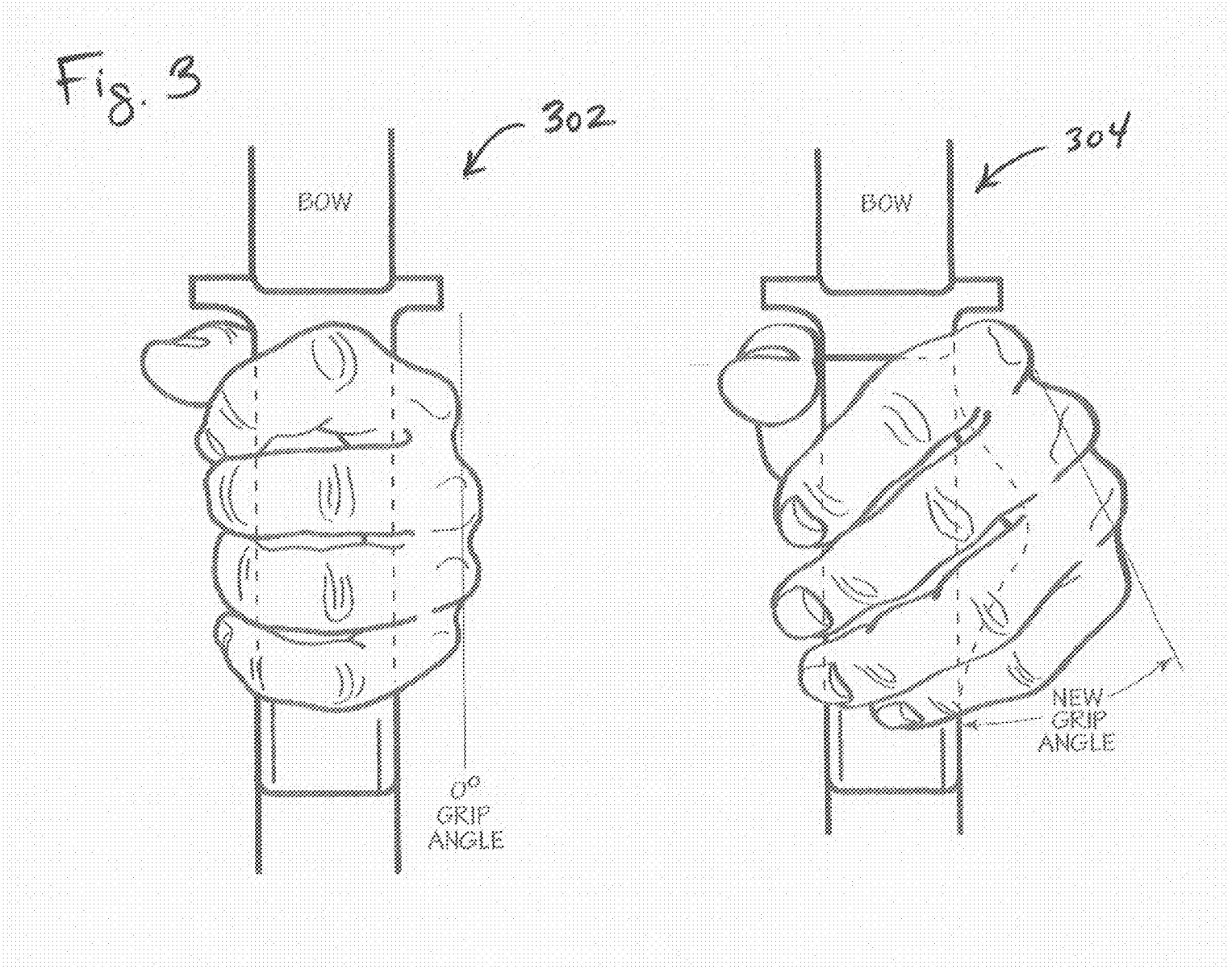
FIG. 3 illustrates a grip incorporating teachings of the present disclosure for improving grip alignment.

Among other benefits that may result from the teachings disclosed herein, an archer using the described gripping systems may experience improved accuracy. The improved accuracy may result from the archer's enlarged grip angle. A conventional grip design can make it difficult for the archer to find the proper shooting position. Modern bows invite users to grab the bow grip and to wrap their fingers all the way around the grip as shown in image 302 of FIG. 3. The result is that the knuckles on the back of the archer's lead-hand (the one holding the bow) define a grip angle that is in line or parallel to the limb-to-limb line of the bow. A parallel grip angle like this defines a zero degree grip angle. As the pinky knuckle of the lead hand is rotated away from the bow, the grip angle grows. For example, if the archer grips the bow such that the back of the hand faces upward and the bow limbs remain perpendicular to the ground, the defined grip angle would be ninety degrees.

As mentioned above, modern grips encourage zero degree grip angles. This is especially true for "ergonomic" grips that include finger depressions that are aligned perpendicular to the limb-to-limb line of the bow and/or palm mounds that fill the hollow formed in the palm area when a person closes his or her fist. It appears that grip design often results from having an individual squeeze a moldable material and then replicating the squeezed shape of the moldable material in the provided grip. The result is often a grip that promotes a zero degree grip angle.

Gripping the bow with a zero degree grip angle can create at least two problems for the typical archer. First, the archer can inadvertently "torque" the bow such that the archer actually twists the bow at release. This twisting throws the arrow off line. Second, a zero degree grip angle can force the meat of the forearm into the string path of the bow. The result is often a painful brushing of the string against the forearm after release. It is not uncommon to see an archer wearing an arm guard on the lead arm to protect the forearm skin from the bowstring. While the guard does protect the archer's arm, the string slapping against the guard can make consistent shot placement very difficult. Moreover, because the string slap from modern bows can be very painful, many archers develop two bad habits, namely, a flinching at release and a bending of the lead arm elbow.

In addition to other benefits apparent to one skilled in the art, the teachings of the present disclosure may help archers maintain a grip angle over zero degrees and a consistent body position when using a bow. As depicted in the figures, a bow may include a grip component that is unitary. The grip component could be an entire grip system that includes a grip, end caps, metacarpal offsets, etc. such as the system depicted in FIG. 1. In some cases, a grip component may help an archer to maintain a desired grip angle like the grip angle depicted in image 304 of FIG. 3. The angle may be greater than twenty degrees and may be between thirty and sixty degrees. In other cases, the desired grip angle may include the smaller range of between forty and fifty degrees. In still other cases, an instructor or coach may narrow the desired range for a given archer to a very specific grip angle. For example, a given archer's physiology may dictate a preferred grip angle of thirty-two degrees. A different archer's physiology may dictate a preferred grip angle of forty-three degrees. To assist the archer in consistently repeating a specific grip angle or working within a grip angle range, a bow grip incorporating teachings of the present disclosure may include a third metacarpal offset. In some embodiments, the grip may include a fourth and a fifth metacarpal offset. In addition, the actual amount of offset may be varied or variable to allow for finer tuning of an archer's grip angle. It should be understood that the metacarpal offset can be located at various positions along the metacarpal. For example, a designer may locate the offset such that it rests under the middle finger knuckle of the lead hand. Such a location may make it more difficult for an archer to grip a bow in a manner that creates a zero degree grip angle.

In practice, the inclusion of one or more metacarpal offsets on a bow grip may disallow the wrap around gripping that creates the conventional zero degree grip angle. It should be understood that the metacarpal offsets could be implemented in many different ways depending on the design and cost preferences of the designer. For example, metacarpal offsets could be built into a factory bow grip, included on an aftermarket replacement grip, included in a lead-hand shooting glove, included in a bow grip cover that attaches to a traditional bow grip, some combination of these options, and/or some other appropriate technique for encouraging proper grip angles.

In a glove embodiment, a designer may elect to include a thumb-to-forefinger webbing structure that dissipates or reduces the amount of pressure felt by the webbing portion between a forefinger and a thumb of the archer's lead hand at full draw. The thumb-to-forefinger webbing structure could be made from a fabric, a plastic insert, a rubber insert, and/or some combination of these. In addition, the webbing structure could be sewn into a glove such that a load bearing structure is formed into a forefinger loop on one end and a thumb loop on the other. The glove may also include a thenar region pad.

As an archer comes to full draw, a great deal of pressure is felt in the thumb/forefinger web and the thenar region of the lead hand. A glove with a thenar region pad may help to dissipate some of this otherwise acute pressure.

However formed, a system incorporating teachings of the present disclosure could be modular and allow for the removal and insertion of different metacarpal offsets. For example, a modular system could include a small sized offset that creates a twenty-five degree grip angle for a given archer, a medium sized offset creates a thirty-five degree grip angle, and a larger sized offset that creates a forty-five degree grip angle. These and other characteristics of the disclosed grip system may be better understood by referencing the figures.

Figure 1:
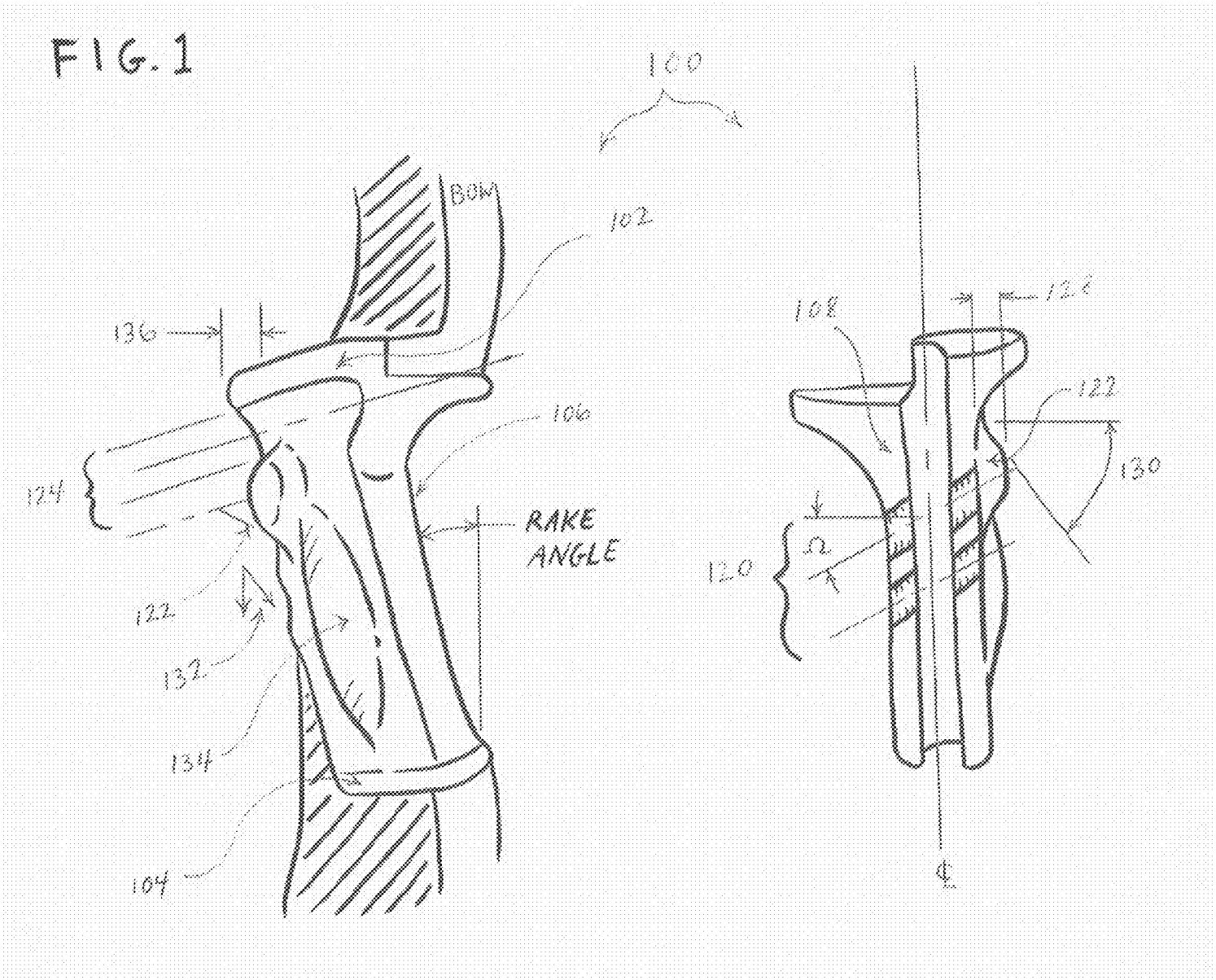
FIG. 1 illustrates multiple views of a grip system incorporating teachings of the present disclosure for improving grip alignment.

As explained above in the brief description of the figures, FIG. 1 illustrates a grip system 100 incorporating teachings of the present disclosure for improving grip alignment. As shown, grip system 100 is a grip system that could be included on a factory bow or added as a replacement grip to an existing bow. System 100 may include one, two, or more component pieces that can be permanently or removably connected to one another to form system 100. Depending on design concerns, system 100 can be made from a single material such as rubber, plastic, wood, metal, etc. In one embodiment, the selected material is non-pliable and capable of maintaining its size and shape. In other embodiments, system 100 may be formed from more than one material. In such an embodiment, selected materials may include a non-pliable material and a pliable gel like material that "gives" a little in response to pressure.

In a version of system 100 made from more than one material, a designer may choose to create system 100 from more than one type of rubber, more than one type of plastic, more than one type of wood, more than one type of metal, and/or various combinations of material types. For example, system 100 may have a metal core, a wood overlay, a rubber metacarpal insert, and plastic end caps.

As shown in FIG. 1, system 100 includes a top end cap 102 and a bottom end cap 104. Caps 102 and 104 can identify separate pieces of a gripping system and/or general locations on a gripping system. System 100 also includes a thenar surface 106. In use, surface 106 can interact with the webbing between an archer's thumb and forefinger as well as the thenar space of the archer's lead hand. Depending on design goals, surface 106 can have a flat cross section or a convex cross section that extends out and into the webbing of the archer's hand. In addition, surface 106 may be designed with or without a rake angle. In practice, if a gripping system has a zero degree rake angle, surface 106 would be parallel to the bowstring. In some embodiments, system 100 may have a ten to twenty degree rake angle. In such an embodiment, the rake angle would result in a "canting forward" of the thumb and forefinger away from the archer at full draw.

As depicted, system 100 also includes a front surface 108 with finger depressions 120. As shown, depressions 120 are not perpendicular to the limb-to-limb line of the bow. As shown, depressions 120 are angled down and away from the archer's palm. This angled depression design may assist the archer in finding a proper grip angle. System 100 also includes a third metacarpal offset 122 that is located such that it will fall under the middle finger knuckle of an archer's hand. Offset 122 is formed such that it creates a forefinger channel 124 that allows the second metacarpal of the archer's lead hand to rest in channel 124. In system 100, the width of channel 124 is fixed. In other embodiments, channel 124 may be adjustable to account for a wide range of hand sizes.

System 100 includes a fixed version of offset 122 with a predefined width, a predetermined offset amount 128, a predetermined feathering angle 130, and a fixed tailing angle 132. In other embodiments, one or more of these offset characteristics may be adjustable. As shown, system 100 also includes a small palm mound 134 on the palm-facing surface 136. In other embodiments, palm mound 134 may be removed to facilitate the finding of a proper grip angle.

Depending on the embodiment deployed, many of the above-described characteristics may be altered and/or alterable. For example, a designer may change the location of offset 122, the rake angle, the cross section of surface 106, the size and location of channel 124, the amount of overhang 136 created by top end cap 102, the amount of overhang created by bottom end cap 104, etc. Moreover, though FIG. 1 depicts system 100 as including several characteristics and components, a designer may choose to add more and/or to remove one or more of the ones depicted in FIG. 1. All of these changes can be made without departing from the teachings of the present disclosure.

Figure 2:
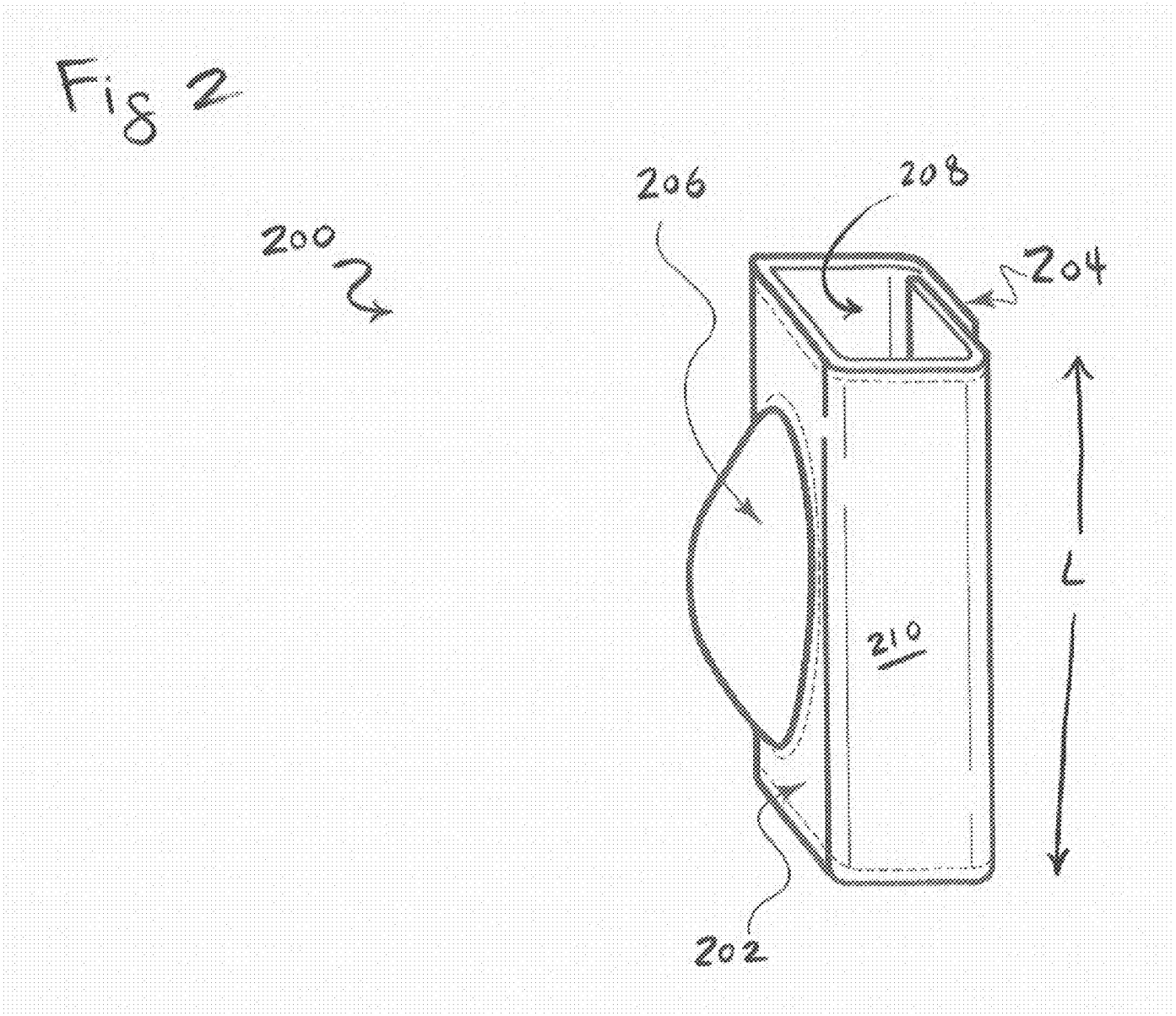
FIG. 2 depicts a grip sleeve incorporating teachings of the present disclosure in order to provide a shooting aid for archers.

As mentioned above, FIG. 2 depicts a grip sleeve system 200 incorporating teachings of the present disclosure. System 200 includes a sleeve 202 that is configured to at least partially wrap around an existing bow grip. In some embodiments, sleeve 202 may have a length dimension that is approximately equal to or smaller than a length dimension of the existing bow grip. In some embodiments, the length dimension may be the same or longer than the length dimension of the existing bow grip. As depicted, sleeve 202 is a complete sleeve that wraps all the way around the existing grip. Sleeve 202 opens up to wrap around the existing grip and then reseals using a hook and loop closure mechanism 204. Other closure mechanisms could also be used. For example, sleeve 202 could include laces that tie or a clasping mechanism. In other embodiments, sleeve 202 could clip onto the existing grip. For example, sleeve 202 may be designed such that it does not completely wrap around the existing grip. In such an embodiment, sleeve 202 may have a relatively rigid shape that is configured to clip onto the existing grip.

As shown, sleeve 202 wraps the existing grip along the entire length of the existing grip. In other embodiments, sleeve 202 may include one, two, or more strips that wrap all the way around the existing grip while leaving much of the existing grip uncovered. In such an embodiment, each of the strips may include its own clasping mechanism. In some embodiments, the size and clasping mechanisms chosen for a sleeve may allow the sleeve to be attached to an existing grip in more than one location. The ability to move system 200 into different mounting positions on an existing grip may effectively allow an archer to adjust the location of an included metacarpal offset.

As shown, system 200 includes a third metacarpal offset 206 that is attached to sleeve 202. In embodiments of system 200 that allow the system to be attached in slightly different positions on an existing bow, this offset 206 may be moved to fit a given archer's hand. In addition, offset 206 may take on varying sizes and shapes depending upon design goals of the developer and hand sizes of archers. Moreover, offset 206 may be formed from one or more types of material. For example, offset 206 may include one or more of a plastic material, a rubber material, a leather material, a metal material, a wooden material, a woven material, and/or some other material that is suitable for performing the objective of offset 206.

As shown, offset 206 is sewed into sleeve 202. A designer could choose other techniques for attaching offset 206 to sleeve 202. In one embodiment, sleeve 202 may be formed to include a pocket into which offset 206 can be removably placed. In such an embodiment, a designer could provide several offsets having various sizes. An archer could shoot his or her bow with each of the offsets to determine which one yields the best results. The archer may then place the chosen offset into the pocket of sleeve 202.

As mentioned above, offset 206 can be connected to sleeve 202 using one or more of several different techniques. System 200 could be formed such that offset 206 and sleeve 202 are part of a unitary system. Offset 206 can be permanently or removeably affixed to sleeve 202. Offset 206 could be glued, sewed, tied, stapled, shrink fit, pocketed, etc. to sleeve 202. However connected, an archer may want offset 206 to remain in a relatively fixed position relative to the existing bow grip. To help make this happen, a designer may rely on one or more techniques. For example, the designer may choose a specific material for sleeve 202 that facilitates the sleeve's ability to stay in a relatively fixed location once it has been attached to an existing bow grip. The material may include a stretchable material like spandex or neoprene. Once clasped or locked in place, the stretchable material may help to hold system 200 in place. A designer may also choose to include a non-slip material on an inside surface 208 of sleeve 202 that resists slipping around the existing grip. Similarly, the designer may choose the same non-slip material or some other desired material for the exterior surface 210 of system 200. The material and/or surface texture of exterior surface 210 may be chosen to feel good in the archer's hand.

A system incorporating teachings of the present disclosure may replace, add, or delete many of the above-described features without departing from the scope of the disclosure. One skilled in the art will recognize that the many of the above-described components could be combined or broken out into other combinations.

Although the present invention has been described in detail, it should be understood that various changes, substitutions and alterations to the devices, methods, and other aspects and techniques of the present invention can be made without departing from the spirit and scope of the invention as defined by the appended claims.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A system comprising:

a grip component configured to couple to a bow and to interact with an archer's lead hand;

a top end cap of the grip component;

a third metacarpal offset of the grip component, the third metacarpal offset configured to encourage a grip angle of between twenty degrees and sixty degrees;

a thenar surface of the grip component, wherein at least a portion of the thenar surface has a convex cross-section and having a rake angle of less than twenty degrees with regard to a bowstring;

a forefinger channel located between the top end cap and the third metacarpal offset, the forefinger channel formed to allow a second metacarpal of the archer's hand to rest in the forefinger channel; and the bow to which the grip component is coupled.

2. The system of claim 1, wherein the grip component is formed as a unitary piece from a single material, and the unitary piece includes the top end cap, the third metacarpal offset, the thenar surface, and the forefinger channel and the single material is selected from a grip consisting of a plastic material, a rubber material, a wooden material, and metal material.

3. The system of claim 1, wherein the bow is a compound bow and the third metacarpal offset is configured to encourage a grip angle of over thirty degrees.

4. The system of claim 1, wherein the top end cap includes a left portion that extends to the left of a centerline defined by a top and bottom limb of the bow and a right portion that extends to the right of the centerline.

5. A system, comprising:

a grip component configured to couple to a bow and to interact with an archer's lead hand, wherein the grip component comprises a vertical axis that is configured such that the vertical axis is parallel to a limb-to-limb line of the bow when the grip component is coupled to the bow, further wherein the grip component comprises a front surface that includes a finger depression channel that has a channel axis that is not perpendicular to the vertical axis;

a third metacarpal offset of the grip component, the third metacarpal offset configured to encourage a grip angle of over twenty degrees; and a bow coupling system configured to facilitate a coupling of the grip component to a bow.

6. The system of claim 5, wherein the bow coupling system includes at least one of a hook and loop fastener, a clasping fastener, a tying fastener, and a compression fastener.

7. The system of claim 5, wherein the grip component is configured to removeably couple with an existing grip of the bow.

8. The system of claim 5, wherein the grip component is configured to replace an existing grip of the bow.

9. The system of claim 1, further comprising a palm mound of the grip component adjacent to the third metacarpal offset.

10. The system of claim 1, further comprising:

a fourth metacarpal offset of the grip component; and a fifth metacarpal offset of the grip component.

11. A system comprising:

a grip component configured to couple to a bow and to interact with an archer's lead hand;

a top end cap of the grip component;

a third metacarpal offset of the grip component, the third metacarpal offset configured to encourage a grip angle of between twenty degrees and sixty degrees, wherein the third metacarpal offset is of a modular system having a plurality of third metacarpal offsets of different sizes, the grip component to enable insertion and removal of given ones of the plurality of third metacarpal offsets;

a thenar surface of the grip component, wherein at least a portion of the thenar surface has a convex cross-section;

a forefinger channel located between the top end cap and the third metacarpal offset, the forefinger channel formed to allow a second metacarpal of the archer's hand to rest in the forefinger channel; and the bow to which the grip component is coupled.

12. The system of claim 11, further comprising:

a fourth metacarpal offset of the grip component; and a fifth metacarpal offset of the grip component.

13. The system of claim 12, further comprising a palm mound of the grip component adjacent to the third metacarpal offset.

14. The system of claim 11, wherein the grip component comprises a vertical axis that is configured such that the vertical axis is parallel to a limb-to-limb line of the bow when the grip component is coupled to the bow, further wherein the grip component comprises a front surface that includes a finger depression channel that has a channel axis that is not perpendicular to the vertical axis.

15. The system of claim 11, wherein at least a portion of the thenar surface has a rake angle of less than twenty degrees with regard to a bowstring.

* * * * *